US007604136B2

(12) United States Patent
Kontetzki

(10) Patent No.: US 7,604,136 B2
(45) Date of Patent: Oct. 20, 2009

(54) COUPLER HEAD WITH DETACHABLE FACE PLATE FOR RAIL VEHICLES AS WELL AS ASSOCIATED METHOD OF ITS ASSEMBLY

(75) Inventor: Arthur Kontetzki, Salzgitter (DE)

(73) Assignee: Voith Turbo Scharfenburg GmbH & Co. KG, Salzgitter (DE)

( * ) Notice: Subject to any disclaimer, the term of this patent is extended or adjusted under 35 U.S.C. 154(b) by 181 days.

(21) Appl. No.: 10/592,649

(22) PCT Filed: Sep. 5, 2005

(86) PCT No.: PCT/EP2005/009532

§ 371 (c)(1),
(2), (4) Date: Sep. 13, 2006

(87) PCT Pub. No.: WO2006/027196

PCT Pub. Date: Mar. 16, 2006

(65) Prior Publication Data

US 2007/0187350 A1 Aug. 16, 2007

(30) Foreign Application Priority Data

Sep. 6, 2004 (EP) ..... 04021149

(51) Int. Cl.
*B61G 5/00* (2006.01)
*B61G 3/00* (2006.01)

(52) U.S. Cl. ..... 213/75 R; 213/77

(58) Field of Classification Search ..... 213/75 R, 213/77, 76, 79, 19, 20, 220, 221 C; 280/416.1
See application file for complete search history.

(56) References Cited

U.S. PATENT DOCUMENTS 3,096,116 A * 7/1963 Kost ..... 293/137
4,375,857 A * 3/1983 Gunther et al. ..... 213/77
4,703,862 A * 11/1987 Werner ..... 213/76
5,472,104 A * 12/1995 Domsgen ..... 213/4
5,509,548 A * 4/1996 Kreher ..... 213/77

(Continued)

FOREIGN PATENT DOCUMENTS

DE 871 464 3/1953

(Continued)

OTHER PUBLICATIONS

Extract from Maintenance Manual to London Underground Central Line Tubestock, 1990, vol. 02.

(Continued)

*Primary Examiner*—S. Joseph Morano
*Assistant Examiner*—Jason C Smith
(74) *Attorney, Agent, or Firm*—Fraser Clemens Martin & Miller LLC; Donald R. Fraser

(57) ABSTRACT

A coupler head (1) for rail vehicles is specified which has a coupler head housing (2) and a face plate (4) closing off the coupler head housing at its front. With the objective of providing a modular structuring to the coupler head (1), the face plate (4) and the coupler head housing (2) are detachably connected to one another. A method of assembling such a coupler head (1) is furthermore described.

13 Claims, 2 Drawing Sheets

U.S. PATENT DOCUMENTS

Figure 1:
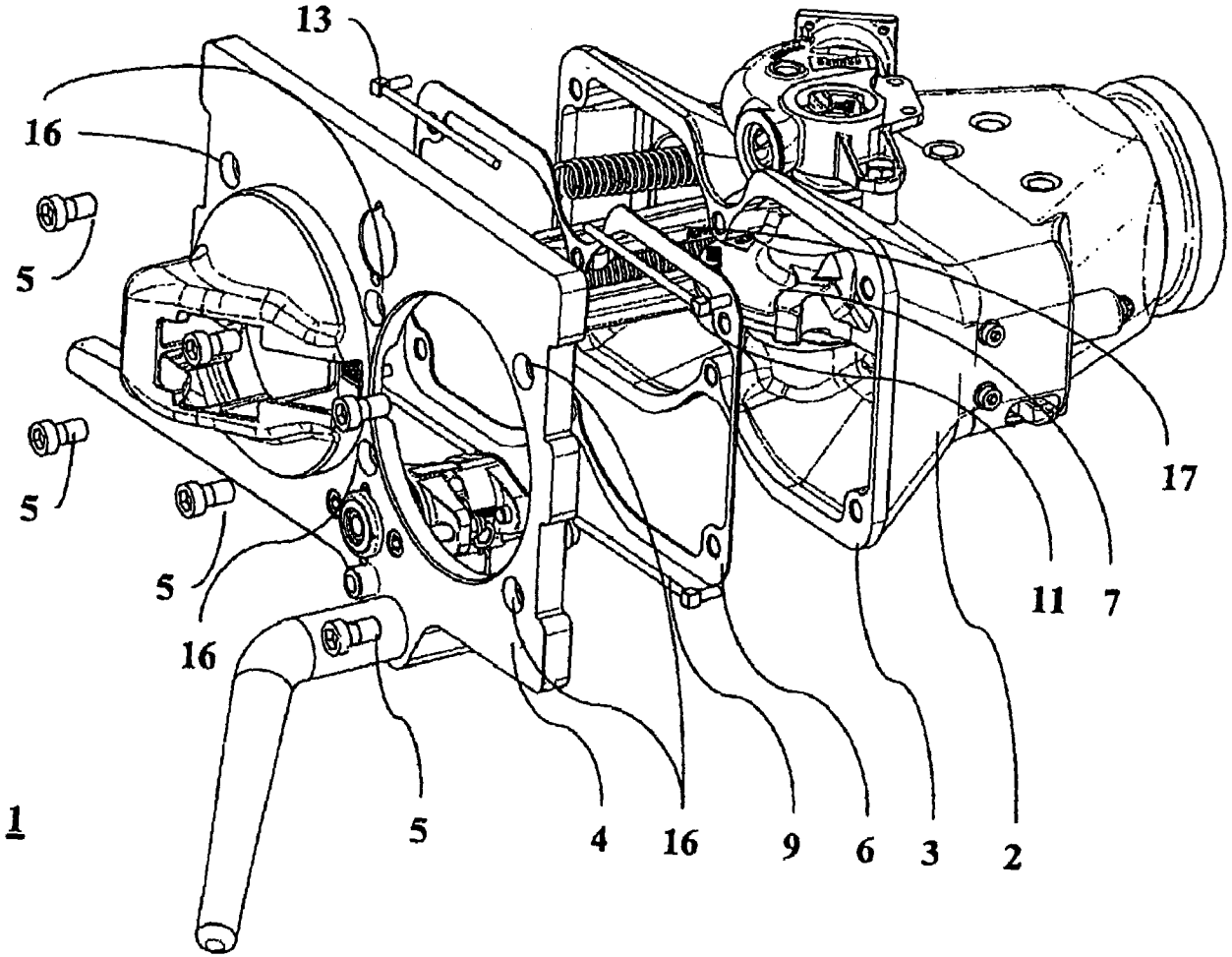

| | | | | |
|---|---|---|---|---|
| 6,008,472 | A * | 12/1999 | Kreher et al. | 219/202 |
| 6,685,040 | B2 * | 2/2004 | Heinisch et al. | 213/221 |
| 6,820,759 | B1 * | 11/2004 | Schindler et al. | 213/221 |
| 7,038,169 | B2 * | 5/2006 | Dittmar et al. | 219/201 |
| 7,055,705 | B2 * | 6/2006 | Sprave | 213/20 |
| 7,125,036 | B2 * | 10/2006 | Moss et al. | 280/511 |
| 7,191,909 | B2 * | 3/2007 | Heinisch et al. | 213/75 R |
| 2002/0178967 | A1 * | 12/2002 | Heinisch et al. | 105/220 |
| 2003/0047547 | A1 * | 3/2003 | Dittmar et al. | 219/201 |
| 2004/0155430 | A1 * | 8/2004 | Zahn | 280/416.1 |
| 2005/0067812 | A1 * | 3/2005 | Moss et al. | 280/416.1 |
| 2005/0121404 | A1 * | 6/2005 | Sprave | 213/75 R |
| 2005/0145591 | A1 * | 7/2005 | Mattschull et al. | 213/75 R |
| 2005/0248098 | A1 * | 11/2005 | Sisk et al. | 277/616 |
| 2005/0255916 | A1 * | 11/2005 | Chen | 463/37 |
| 2005/0280245 | A1 * | 12/2005 | Eberle | 280/416.1 |
| 2006/0217231 | A1 * | 9/2006 | Parks et al. | 482/3 |
| 2006/0246969 | A1 * | 11/2006 | Penello et al. | 463/1 |
| 2006/0249470 | A1 * | 11/2006 | Sprave | 213/75 R |
| 2006/0289580 | A1 * | 12/2006 | Faver et al. | 224/521 |
| 2007/0035107 | A1 * | 2/2007 | Planz | 280/416.1 |
| 2007/0107623 | A1 * | 5/2007 | Radewagen | 105/50 |
| 2007/0187350 | A1 * | 8/2007 | Kontetzki | 213/75 R |

FOREIGN PATENT DOCUMENTS

| | | |
|---|---|---|
| DE | 871464 | 3/1953 |
| DE | 1 124 535 | 3/1962 |
| DE | 1124535 | 3/1962 |

OTHER PUBLICATIONS

Close-up photograph of front plate illustrated in Extract.
Dobell, Malcolm, London Underground Rolling Stock Information, Apr. 2003.

* cited by examiner

COUPLER HEAD WITH DETACHABLE FACE PLATE FOR RAIL VEHICLES AS WELL AS ASSOCIATED METHOD OF ITS ASSEMBLY

The present invention relates to a coupler head for vehicles able to be coupled together having a coupler head housing and a frontal face plate closing off the coupler head housing. The present invention further relates to a method of assembling such a coupler head.

There are numerous descriptions of coupler head housings for couplable vehicles in the technical and patent literature. The DE 43 12 405 A1 document, for example, describes a central buffer coupling for rail vehicles which additionally comprises a protective device.

Printed publication DE 82 10 877 further makes known an electrical heater for central buffer couplings. Heaters are installed into central buffer couplings in order to ensure trouble-free operation during the winter. In particular, integrated heaters are to ensure that the frontal face plate remains free of snow and ice so as to secure reliable function of the coupling. Printed publication U.S. Pat. No. 6,008,472 also describes the inclusion of heating elements in the face plate of coupler head housings using the example of a central buffer coupling of the Scharfenberg design.

With respect to the present invention, three primary Scharfenberg couplings are known, same indicated here exemplarily, although not exclusively: a mainline coupler identified as Type 10. The mainline coupler head is characterized by a large gathering range both vertically and horizontally, engendered by its guiding horn and a lateral extension. This characteristic ensures universal applicability. The mainline Type 10 coupler head is used by virtually all European national railways and throughout the world, e.g. in Asia, Australia and South Africa. The materials and design chosen for the head and lock elements, proven in type testing, are of optimum configuration to meet UIC[1] requirements as to tractive and compressive forces. If required, the face plate can be provided with a heater to ensure trouble-free operation during winter. Also known are Metro couplers having a wide range of application from light rails to commuter trains.

[1] Union Internationale des Chemins de Fer=International Union of Railways

Common to all constructions of central buffer couplings and coupler head housings known to date, however, is that they are all designed and manufactured as one single body. For example, printed publication DE 11 24 535 B describes a housing for rigid, automatic central buffer couplings comprising a face plate having a pyramid-shaped projection and a corresponding recess on the buffer surface, an end piece for connecting the housing to a coupling rod, and the actual housing body positioned between the face plate and the end piece, made of individually-formed components in cell-type construction. It is thereby provided for both the face plate as well as the end piece to be produced by forging or casting and fixed together by connective elements. However, this prior art construction requires that the coupling and the coupler head housing be designed and manufactured as one entirety.

Although the invention is described using the example of coupler heads for rail vehicles, it is expressly noted at this point that the invention in fact relates to coupler heads in general. For example, this would also include coupler heads for vehicle couplings or for magnetic levitation transport systems. Reflecting this, the present specification thus uses the expression "coupler head for couplable vehicles."

Modular concepts for coupler heads are not known to date. Each housing element has a face plate which is fixedly connected, i.e. not detachable, to the rest of the coupler head housing, for example by welding the face plate on or forming it integrally with the rest of the coupler head housing. In the early stages of coupler head housings, the housing was formed from an upper and lower housing half shell. The process subsequently moved on to manufacturing the coupler head housing as one piece, the face plate being subsequently welded onto the coupler head housing. Because of the welding involved and the thermal expansion associated with same, it has to date not been possible to include all drill holes, grooves and recesses prior to welding. Instead, the entire coupler head had to be machine-finished in detail following its being welded together. In particular, drill holes and grooves could only be added subsequently. To date, this has had the result of high machining costs. Another factor is the diversity of product variants which leads to further high costs as regards manufacturing and warehousing. Additionally unavoidable up to this point was only being able to fit the coupling components situated within the housing in a subsequent laborious and intricate procedure; i.e. driving the costs up.

Based on the problems as set forth above in terms of the multiplicity of variants, the lack of modularity, the need for machining and the problems associated with assembly, the present invention addresses the task of further developing the design of coupler head housings for rail-mounted vehicles which comprise face plates as known from the prior art so as to enable modular configuration and face plates which can be mounted to various different rear coupling housings.

This task is solved in accordance with the invention by the coupler head housing—i.e., the rear part of the coupler head—being detachably connected to a face plate fit against the coupler head housing.

This type of design to a coupler head offers a number of advantages over conventional welded-together coupler heads. The detachable connection between the coupler head housing and the face plate allows an overall optimizing of the coupler head's properties and its manufacturing process. It reflects a modular concept in which different coupler head housings can be mounted in turn on different face plates. It is no longer necessary to design and manufacture the entire coupler head as a complete whole. The face plate can also be removed for maintenance or repair within the coupler head housing so that service technicians can easily access the uncoupling cylinder and the other components of the complete coupler lock unit.

Other advantageous embodiments and further developments of the invention are given in the subclaims.

It is preferably provided for the coupler head housing not to exhibit any design features related to only one type of coupler head. Such design features related to specific types of coupler heads are disposed at, in or on the face plate. The modular construction to the coupler head thus achieved, consisting of coupler head housing and face plate, additionally allows the uncoupling cylinder and the entire coupler lock to be premounted in the coupler head housing prior to affixing the face plate and closing the coupler head housing.

The phrase "design features related to a type of coupler head" refers to all fundamental construction-dependent features common to one type of coupler head and which characterize the function of the coupler head type. An example of just such a design feature related to a type of coupler head is the specifying of the gathering range or the size and/or shape of the funnel or cone, since such features are characteristic of the lock for the coupler head.

A compensating element is advantageously positioned between the coupler head housing and the face plate. Selecting from among different strengths allows this compensating element to adjust for, among other things, manufacturing tolerances and coupling play. The compensating element can additionally serve to separate different materials of the coupler head housing and the face plate.

Moreover, the compensating element is preferably configured in such a way so as to essentially correspond to the cross-sectional geometry of the front face of the coupler head housing, similar to a seal. Yet the compensating element is not limited exclusively to the cross-sectional geometry of the front face of the coupler head housing. It can protrude over the edge of the coupler head housing front face on both sides; i.e., both inwardly or outwardly. The compensating element also allows the realizing of a number of other functions as will be described somewhat further below.

In place of the compensating element realized, for example, in the form of a large plate, a number of spacer elements can also be used, for example a plurality of shims which are smaller than the compensating element and arranged, for example, at substantially small-scale or even point-contact on the connecting elements between the coupler head housing and face plate as still to be described below.

Additionally of advantage is to provide for the compensating element to be made of plastic, although just as conceivable are other materials such as, for example, metal or multi-component materials. The compensating element or the plurality of spacer elements respectively can then, in addition to its/their function related to compensating for manufacturing tolerances, also provide a separation between possibly different materials of the face plate and the coupler head housing. Using different materials for the compensating element also allows different pressure and sound transmission properties between the face plate and the coupler head housing. This thus yields an additionally adjustable damping effect when the face plate and the coupler head housing are coupled. This damping effect further yields reduced noise during the coupling process. In the case of a passenger car, this means an even further decrease in the noise level during coupling and while in motion, along with the related lessened noise annoyance for the passengers. Yet, of course, even conventional sheet metal is conceivable for the compensating element.

In order to avoid the disadvantages associated with the older designs of coupler head housings consisting of upper and lower shells and to additionally optimize the manufacturing process, it is preferably provided for the coupler head housing to consist of one piece. Feasible in this regard would be, for example, for the coupler head housing to be configured as a welded housing. Of course, other types of integrally-formed coupler head housings are also conceivable.

In terms of the material for the coupler head housing, the following advantageous alternatives can be used in accordance with the invention: on the one hand, it can be provided to have the coupler head housing be made from glass fiber-reinforced material, in particular glass fiber-reinforced carbon fiber material or other such similar composite. The use of such a material offers a number of positive advantages over conventional metal such as, for example, very high resistance to weather and corrosion, electrical insulating capability and low sound transmitting properties which acts to further reduce noise during coupling and while in motion. Reducing overall weight, a major factor for couplings, is another advantage resulting from the use of glass fiber-reinforced materials, glass fiber-reinforced carbon fiber material in particular.

On the other hand, a coupler head housing made from metal, for example of precision-cast material, is another viable alternative. As same is produced by conventional manufacturing methods, it is not necessary to change the coupler head housing manufacturing process when realizing the present invention.

One embodiment of the invention additionally provides for manufacturing the face plate from precision-cast material. This has the substantial advantage of being able to realize various drillings, grooves and recesses on the face plate in one manufacturing process, thereby dispensing with additional machining steps. Of course, the face plate can also be manufactured in a different way, for example from regular cast material or by the forging and casting of other suitable materials. It is also conceivable to manufacture the face plate from a non-metallic material.

At its rear side, the face plate has recesses configured as grooves for receiving heating elements. These heating elements ensure that the face plate and thus the coupler head can be heated while being operated during inclement winter conditions so as to provide, for example, deicing of snow or ice. Such heating elements have to date had to be mounted into grooves or drill holes which had been subsequently milled. The grooves would then be resealed with hard solder. The design to the coupler head proposed by the invention also dispenses with the need for this laborious unit processing.

The major advantages to the modular structuring and, in particular, to the above-described compensating element as realized by the invention become apparent when additionally making use of heating elements given that the heating elements mounted at the rear side are simply held and covered in their grooves.

Bolts are preferably used to mount the face plate to the coupler head housing when connecting the coupler head housing to the face plate. The compensating element is thereby situated between the coupler head housing and the face plate. Virtually any type of connective element can be used in order to mount the face plate to the coupling housing. Cylinder head bolts or countersunk screws are one conceivable embodiment. The bolts in this case can either engage with prefabricated threads in the coupler head housing or be realized as stud bolts. Such stud bolts will then project through the face plate and a hole configured as an eye in the coupler head housing in order to be fixed at the rear side with a nut.

The task addressed by the present invention is furthermore solved by a method for assembling a coupler head according to the invention which encompasses the following procedural steps. Should heating elements be provided in the coupler head, same are first inserted into the grooves of the face plate. The compensating element is then inserted or positioned against the face plate as required. The coupling housing already contains the pre-mounted uncoupling cylinder and the complete coupler lock. The thereby pre-assembled face plate and thereby pre-assembled coupler head housing are then joined and fastened together with the bolts. Assembling the coupler head in this manner does away with the need for welding and eliminates lengthy cooling times and the need for machining of the coupler head. In consequence thereof, potential sources of defect in the manufacturing process can also be eliminated such that the coupler head can be produced at a higher manufacturing quality.

It is obvious to one skilled in the art that it is not necessarily imperative to pre-mount the uncoupling cylinder and the coupler lock prior to joining the two main components of the coupler head together; i.e., the coupler head housing and the face plate. It would be just as feasible to undertake mounting of the uncoupling cylinder and the coupler lock subsequent assembly, as is the general practice today with coupler heads. Yet—and as provided for in accordance with the invention— the prior mounting of the uncoupling cylinder and the coupler lock yields substantial advantages in terms of process flow, the accessibility of the components during assembly, and maintenance of the coupler head.

The following will make reference to the drawings in describing an embodiment of the inventive device in greater detail.

Figure 2:
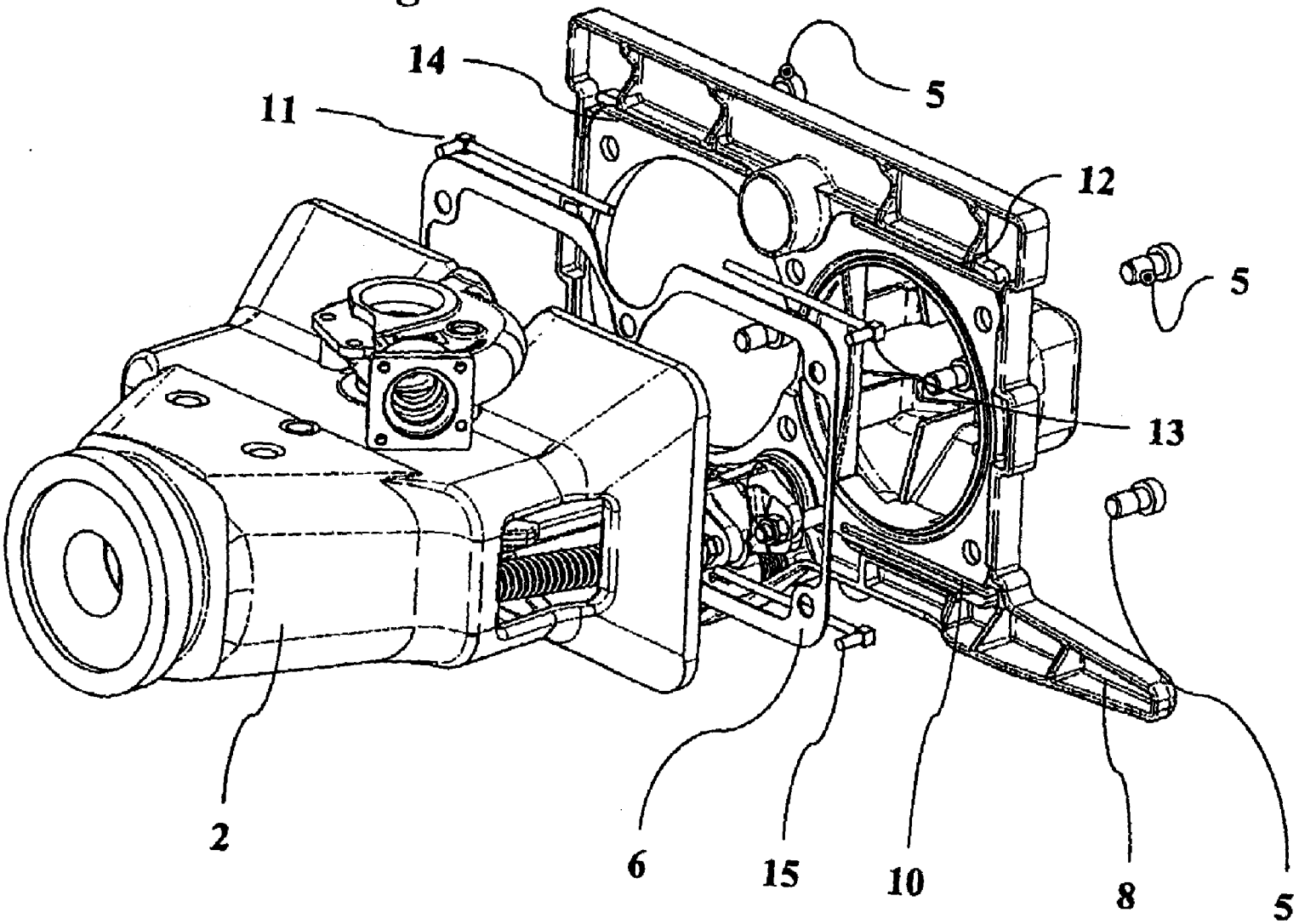

Shown are:

FIG. 1—a coupler head for couplable vehicles made of essentially two parts; specifically coupler head housing 2 and face plate 4; and FIG. 2 a rear view of the coupler head 1, in which the positions of grooves 10, 12, 14 of heating elements 9, 11, 13, 15 are particularly visible.

FIG. 1 shows a conceivable configuration for a coupler head 1 of modular construction, consisting of the two fundamental components of a face plate 4 and the actual coupler head housing 2. A compensating or spacer element 6 can be provided between coupler head housing 2 and face plate 4. Said compensating element 6 serves to equalize or eliminate any differences there may be between the face side of coupler head housing 2 and face plate 4. As shown in FIG. 1, the compensating element can be a compensating plate 6. It is further conceivable here to make additional or alternative use of spacer elements, for example configured as shims. Needless to say, the compensating and spacer elements are not constitutive structural members of the inventive device.

A further component of the device are the heating elements 9, 11, 13, 15, which are positioned between coupler head housing 2 and face plate 4. By means of connecting members—cylinder head bolts 5 extending through drill holes 16 in face plate 4, for example—face plate 4 is mounted to the coupler head housing together with the compensating element 6 as used in the embodiment depicted. The parts form-fit to one another.

In addition, coupling organs 7, 17, in particular the uncoupling cylinder and the coupler lock, are already premounted in coupler head housing 2.

FIG. 2 shows grooves 10, 12, 14 provided in face plate 4 for receiving heating elements 9, 11, 13, 15. The groove for heating element 9 is covered in this particular depiction and thus not visible. When face plate 4, compensating element 6 and coupler head housing 2 are joined, heating elements 9, 11, 13, 15 are fixed and sealed in grooves 10, 12, 14, 16 by compensating element 6. Compensating element 6 can thereby be made of metal or of plastic, for example, whereby plastic offers the advantages of a damping effect and a separation between the different materials of face plate 4 and coupler head housing 2.

The following will make reference to FIGS. 1 and 2 in briefly describing the method of assembly according to the invention.

First, heating elements 9, 11, 13, 15 are inserted into grooves 10, 12, 14 of face plate 4. Compensating element 6 is thereafter positioned against the face plate. Alternatively, it is also possible to insert compensating element 6 into a recess on face plate 4. Coupling organs 7, 17 are thereafter mounted in the still-open coupler head housing. The components pre-assembled in this way are then joined together by means of bolts 5, which are led through holes 16 in face plate 4 and the corresponding holes of compensating element 6, by screwing the bolts into the corresponding threads in coupler head housing 2. It is hereby not absolutely necessary for coupling organs 7, 17 to be mounted prior to the joining with the coupler head housing. This procedural step can also take place after joining together the face plate 4 and the empty coupler head housing 2.

Of course, it is also possible to assemble the coupler head according to the invention without compensating elements. In this case, the heating elements 9, 11, 13, 15 are inserted into grooves 10, 12, 14 of face plate 4, whereby the coupling organs 7, 17 can be thereafter mounted into the still-open coupler head housing. The components pre-assembled in this way are then joined together by bolts 5 in the manner as previously described, specifically by screwing the bolts into the corresponding threads in coupler head housing 2.

LIST OF REFERENCE NUMERALS

1. coupler head
2. coupler head housing
3. front face of coupler head housing
4. face plate
5. bolts
6. compensating element
7. coupling organ
8. rear side of face plate
9. heating element
10. groove
11. heating element
12. groove
13. heating element
14. groove
15. heating element
16. drill hole in face plate
17. coupling organ

The invention claimed is:

1. A coupler head for vehicles which can be coupled together, comprising a coupler head housing and one of a plurality of face plates for closing off said coupler head housing at an open front face of said coupler head housing, wherein said coupler head housing substantially encloses and has internal coupling components for coupling the coupler head with a vehicle, and each of said face plates is designed for a different type of coupler head, wherein design features related to a specific type of coupler head are disposed at, in or on an associated one of said face plates, the design features characterizing the function of the coupler head type, whereby when each of said face plates is separately detachably connected to said coupler head housing, said coupler head housing and the connected one of said face plates functions as the associated specific type of coupler head.

2. The coupler head according to claim 1, wherein an element is disposed between the coupler head housing and the face plate, said element serving as a compensating element.

3. The coupler head according to claim 2, wherein said element is made of plastic.

4. The coupler head according to claim 3, in which a compensating element is provided between the coupler head housing and the face plate, wherein the face plate exhibits grooves on its rear side for receiving heating elements, and wherein said compensating element covers and fixes the grooves and the heating elements disposed therein in the assembled state of coupler head.

5. The coupler head according to claim 2, wherein said element essentially exhibits the cross-sectional geometry of the front face of the coupler head housing.

6. The coupler head according to claim 1, wherein at least one element is disposed between the coupler head housing and the face plate, said at least one element sewing as a spacer element.

7. The coupler head according to claim 6, wherein said at least one element is made of plastic.

8. The coupler head according to claim 1, wherein the coupler head housing is of integral configuration.

9. The coupler head according to claim 1, wherein the coupler head housing is made from a glass fiber-reinforced material, in particular glass fiber-reinforced carbon fiber material or other such similar composite.

10. The coupler head according to claim 1, wherein the coupler head housing is made of metal.

11. The coupler head according to claim 1, wherein the face plate is manufactured from a precision-cast material.

12. The coupler head according to claim 1, wherein the face plate exhibits grooves on its rear side for receiving heating elements.

13. The coupler head according to claim 1, wherein the coupler head housing and the face plate are connected to each other by means of connective elements, in particular bolts.

* * * * *